US008375712B2

(12) United States Patent
Büsselmann

(10) Patent No.: US 8,375,712 B2
(45) Date of Patent: Feb. 19, 2013

(54) WATER EXPLOSION ENGINE, METHOD, AND DEVICE

(75) Inventor: Manfred Büsselmann, Larnaka (CY)

(73) Assignees: Manfred Büsselmann, Larnaka (CY); Mantel & Sohn internationaler Lizenzhandel KG, Müunchen (DE); Hermes Ges. f. Komm. Marketing & Unternehmensberatung mbH, Grassau (DE)

( * ) Notice: Subject to any disclaimer, the term of this patent is extended or adjusted under 35 U.S.C. 154(b) by 431 days.

(21) Appl. No.: 12/085,718

(22) PCT Filed: Nov. 27, 2006

(86) PCT No.: PCT/DE2006/002090

§ 371 (c)(1),
(2), (4) Date: Oct. 3, 2008

(87) PCT Pub. No.: WO2007/062626

PCT Pub. Date: Jun. 7, 2007

(65) Prior Publication Data

US 2009/0173069 A1 Jul. 9, 2009

(30) Foreign Application Priority Data

Nov. 30, 2005 (DE) ..... 10 2005 063 294

(51) Int. Cl.
*F01B 29/00* (2006.01)

(52) U.S. Cl. ..... 60/512; 60/514

(58) Field of Classification Search ..... 60/508–515, 60/620, 623, 624

See application file for complete search history.

(56) References Cited

U.S. PATENT DOCUMENTS 1,226,500 A 5/1917 Fuehler ..... 329/399

(Continued)

FOREIGN PATENT DOCUMENTS

CN 2072594 3/1991
CN 1405442 3/2003

(Continued)

OTHER PUBLICATIONS

International Search Report for International App. No. PCT/DE2006/002090, Oct. 1, 2007.

*Primary Examiner* — Hoang Nguyen
(74) *Attorney, Agent, or Firm* — Kusner & Jaffe

(57) ABSTRACT

The invention relates to a method for producing superheated steam in an engine in which highly compressed water is injected into a very hot medium located in the engine, resulting in explosion-like evaporation. Said process is to take place in a specially developed rotational-translational engine in order to utilize a maximum of the thrust of the steam. The engine is to comprise at least two cylinders which have a circular cross-sectional shape (10) and inside which the drive shaft (11) is disposed eccentrically. A rotor (12) that is connected to an element (16) which is inserted through the drive shaft (11) is arranged on the drive shaft. Said element (16) can be moved back and forth in the drive shaft (11) while the ends thereof are fixedly anchored to the rotor (12). The two ends of the rotor (10) are provided with a specially designed triple-roll seal (13) that can lengthen and shorten the rotor (10), which is a requirement when the drive shaft (11) is placed non-axially in a circular cylinder (10). The rotor (10) has an elongate, elliptical shape and separates the cylinder chamber (10) into two expanding and contracting working chambers A and B.

17 Claims, 5 Drawing Sheets

U.S. PATENT DOCUMENTS

| | | | | |
|---|---|---|---|---|
| 1,390,562 | A * | 9/1921 | Kelly | 60/515 |
| 1,597,542 | A | 8/1926 | Polsley | 418/184 |
| 2,791,881 | A * | 5/1957 | Denker | 60/619 |
| 3,251,183 | A * | 5/1966 | Whitlow | 60/514 |
| 4,432,203 | A * | 2/1984 | Fischer | 60/511 |
| 4,437,308 | A | 3/1984 | Fischer | 60/514 |
| 4,601,170 | A * | 7/1986 | Fiege | 60/513 |
| 2005/0189437 | A1 | 9/2005 | Alexander | 239/332 |

FOREIGN PATENT DOCUMENTS

| | | |
|---|---|---|
| DE | 196 28 867 | 1/1998 |
| EP | 0287906 | 10/1988 |
| JP | 58-027805 | 2/1983 |
| JP | 02-275007 | 11/1990 |
| RU | 2 093 694 C1 | 10/1997 |

* cited by examiner

Exhaust
35
33
34
Drive shaft bearing
36
Induction opening
37 Water injection opening
31
Cylindrical hole
32

Cross section

Longitudinal section

WATER EXPLOSION ENGINE, METHOD, AND DEVICE

BACKGROUND OF THE INVENTION

Conventional petrol and diesel internal combustion engines produce not only hazardous exhaust gases but also convert about 50% of the fuel during the combustion process into heat which is not used to drive the engine, but must be eliminated by cooling in order to avoid overheating the engine. Furthermore, the engines require extensive technical complexity for a crank shaft, cam shaft and valves, which incur costs, are subject to wear and increase the weight.

SUMMARY OF THE INVENTION

The aim of the present invention is to provide a method and a device that overcome the disadvantages of internal combustion engines. This is achieved by a water-explosion and an engine which is suitable for this purpose. Water is injected at high pressure into a hot medium, so it is atomized into small droplets of 1 $\mu m^3$, which are immediately and explosively changed to superheated steam. This innovative method overcomes virtually all the negative phenomena that accompany internal combustion engines.

According to the inventive method, a medium which has been heated to several hundred degrees Celsius is fed into the engine, into which water to which a pressure of 1500 bar has been applied, is injected (claim 1a and 1b).

On the basis of our scientific experiments and the laws of physics, the water is atomized immediately into small droplets with a size of 1 $\mu m^3$ in these conditions, thus resulting in 1 $mm^3$ of water creating a billion droplets. The increase in the water surface area that is achieved in this way results in the droplets being changed explosively to superheated steam (claims 1 and 2).

It was necessary to develop a suitable engine in which the steam can carry out work (claim 3). The steam moves the rotation-translation rotor forwards to half a revolution of the drive shaft. The steam and the hot medium are then forced back by the rotor through the outlet opening in the side wall of the engine, and the steam is condensed again by a cooling device, to form water (claim 4).

In order to avoid heat being unnecessarily lost, the entire engine is enclosed in an insulating capsule. The engine is therefore optimally at an operating temperature of several hundred degrees Celsius (claim 5).

The necessary structure is designed as follows, and will now be explained with reference to exemplary embodiments and the attached schematic drawings.

DETAILED DESCRIPTION OF THE INVENTION

Figure 1A:
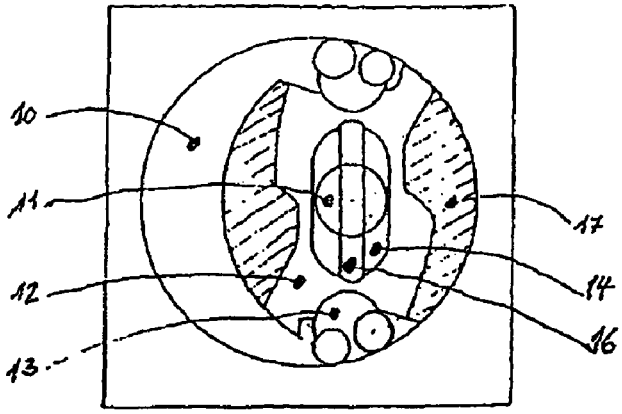
FIG. 1 shows the functional principle of the water-explosion engine.

The rotation-oscillation rotor (12) moves in a circular cylinder (10) which is closed on both sides by a side wall (33) and in which the bearing for the drive shaft (11) is arranged eccentrically. The rotor is in the form of an ellipse which is sealed at both ends by a specially developed seal comprising three rollers (13). As a result of the eccentric arrangement of the drive shaft (11) in a circular cylinder (10), the rotor (12) must have a different length in each position of its rotation, in order to ensure sealing against the cylinder wall. This object is achieved by the 3-roller seal (13), illustrated in four different positions during revolution, in FIGS. 1*a* to 1*d*.

A moving connecting rod plate (16) is passed through the drive shaft (11) within the rotor (12), which has a free space (14) in the center, is connected to the rotor and allows it to carry out its oscillation-translation movement, in order to cause the drive shaft to carry out a rotary movement.

The openings for the outlet for the steam and medium (35) as well as the inlet for the hot medium (36) and for the water injection (37), as well as the hole (34) for the drive shaft bearing, are located in the side wall (33) of the housing (32). The inlet for the heated medium (36) is closed by the rotor, and is opened only when the depression (17) which has been milled out in the rotor, illustrated as a dashed-line shaded area, passes over the inlet (36) during its rotation. During this phase, the rotor sucks the incandescent burner gases into the cylinder area.

Figure 1B:
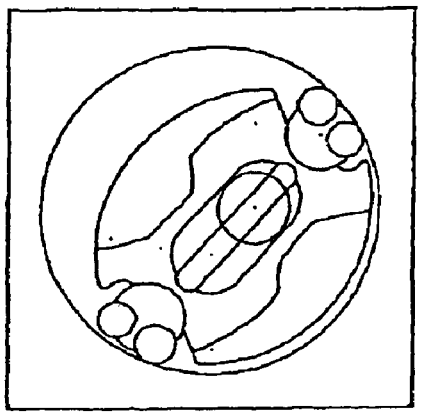
Figure 1C:
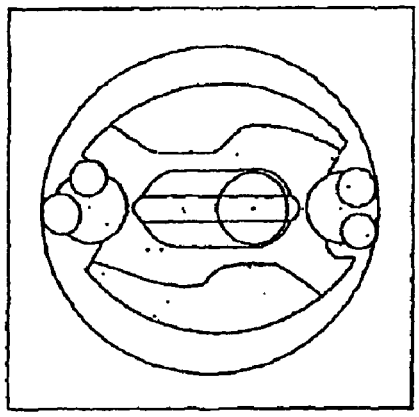
Figure 1D:
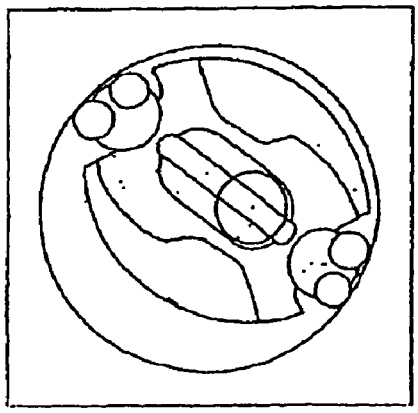
Figure 2:
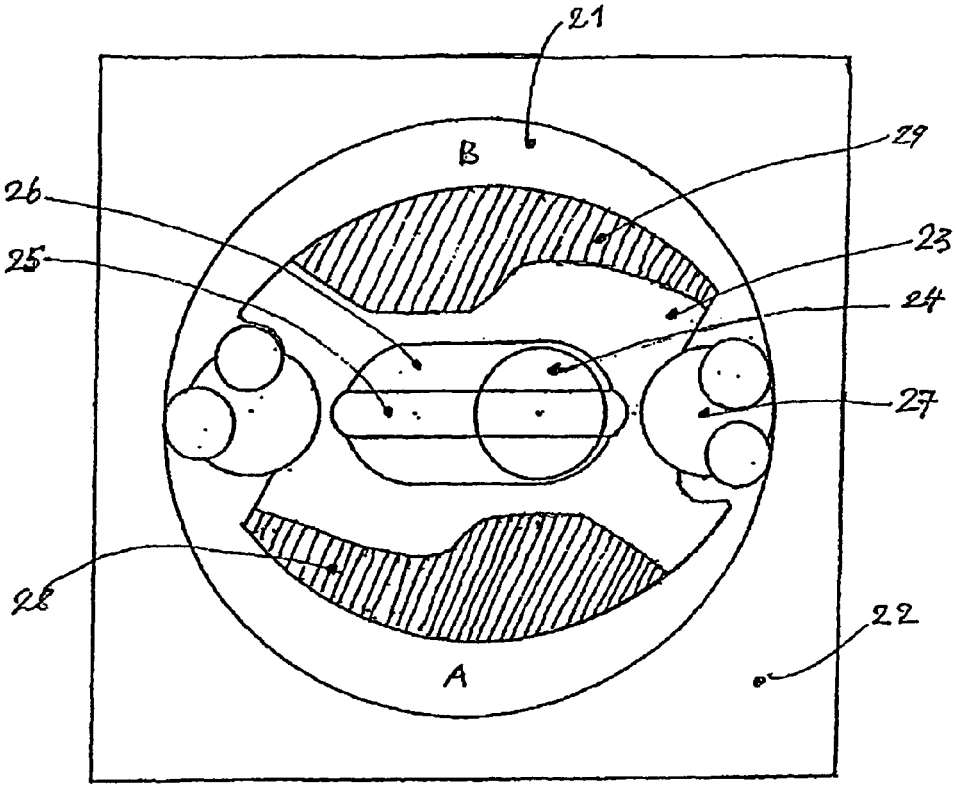
FIG. 2 shows a schematic cross-sectional illustration through the housing and the rotation rotor, as well as the drive shaft and the connecting rod plate.
Figure 3:
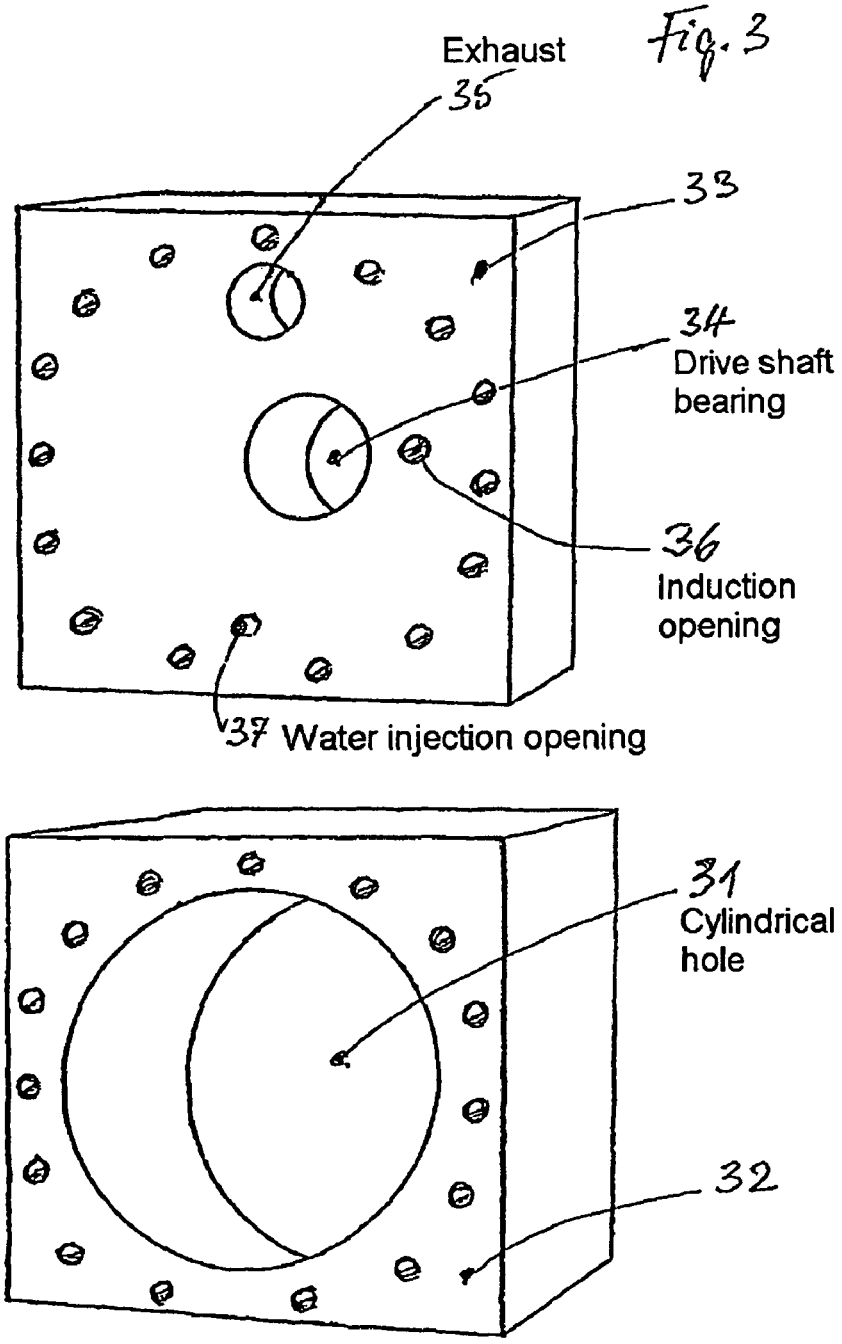
FIG. 3 shows a perspective illustration of the housing block and of the side wall.
Figure 4:
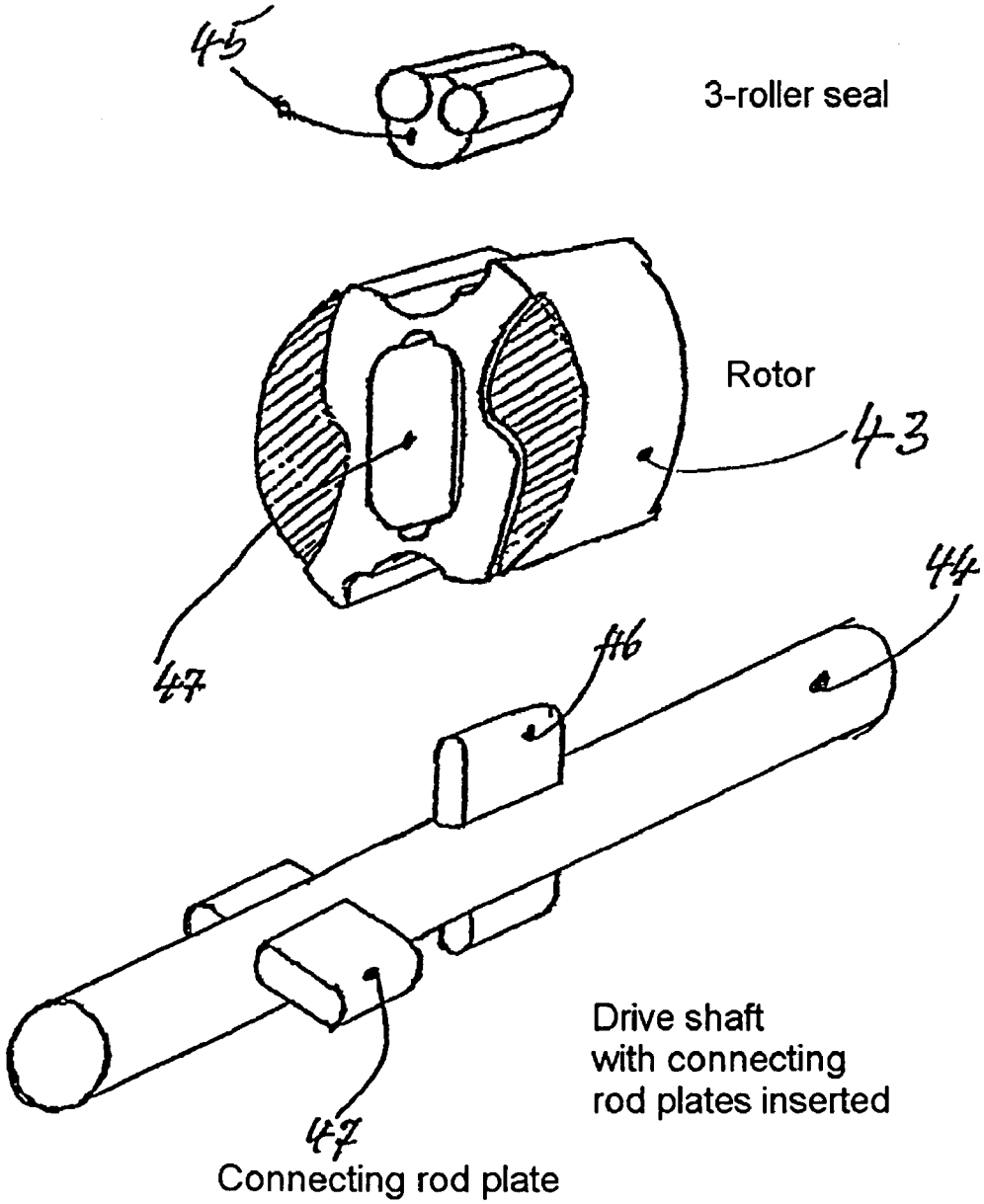
FIG. 4 shows a perspective illustration of the sealing rollers, of the rotor and of the drive shaft with the connecting rod plates inserted.
Figure 5:
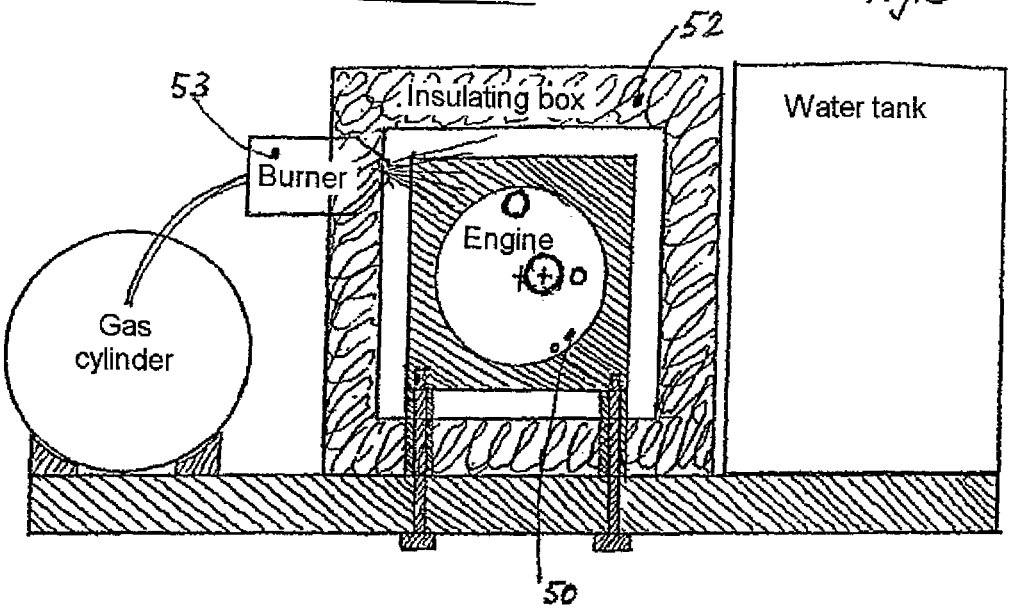
FIG. 5 shows one schematic, possible arrangement of the engine in the insulating box.
Figure 5:
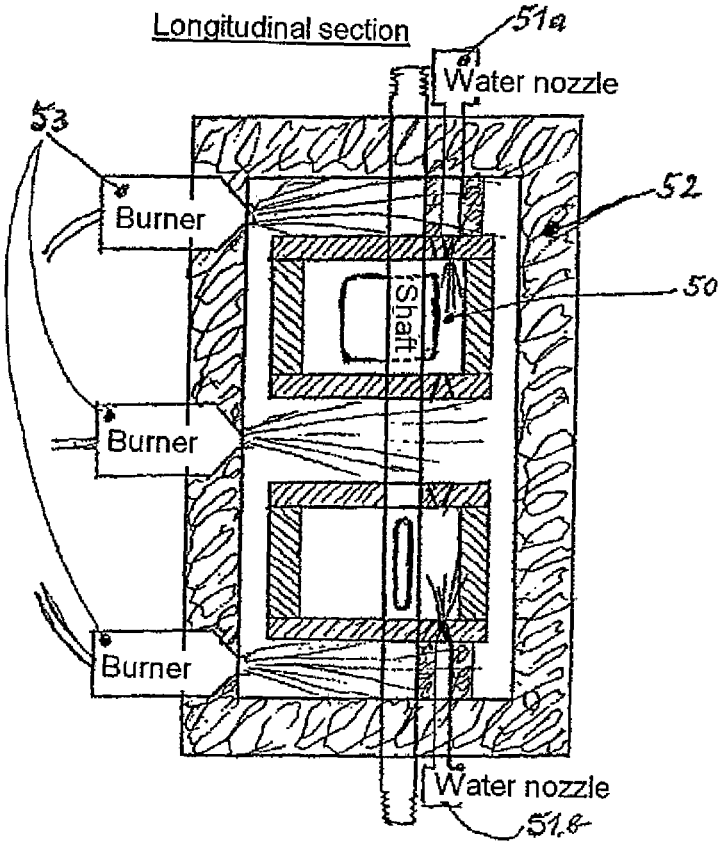

The water is injected at a pressure of about 1500 bar when there is sufficiently hot medium in the chamber A which is formed between the rotor and the cylinder wall. Preferably when the rotor has moved forwards through 32° (FIG. 1*b*).

According to the laws of physics, the water which has been injected at a pressure of 1500 bar is atomized into small droplets with the size of 1 $\mu m^3$ in the medium, which is at the environmental pressure of about 1 bar. This means that 1 $mm^3$ of water results in approximately 1 billion droplets which are immediately and explosively converted to superheated steam in the medium, which has been heated to several hundred degrees Celsius. The power developed by steam is known from conventional steam engines.

The outlet for steam and medium (35) is permanently open. While the rotor is subject to steam pressure in the chamber A, it forces the steam-medium mixture out in the opposite chamber B. This means that two steam explosions will have taken place during each revolution of the shaft. After leaving the engine, the steam-medium mixture passes through a suitable cooling device in which the steam condenses again to form water, so that only hot air leaves the exhaust. The incandescent medium is produced by a suitable propane-gas burner (53) or heating-oil burner. The entire engine is surrounded by an insulating sheath (52) so that the heat from the burner is not immediately lost, but also heats the engine.

As far as possible, the engine is intended to be at the operating temperature of several hundred degrees Celsius, and only the heat loss resulting from vaporization of the water is used to drive the engine. The energy consumption should be considerably less than conventional engines and, in addition, the exhaust gases that are created by the continuous combustion of the fuel will be considerably less, with present-day burner technology, than in the case of diesel or petrol explosion engines.

Having described the invention, the following is claimed:

1. A method for driving an engine by atomizing water for steam production, wherein a medium is heated to form a heated medium, said heated medium is introduced into an engine area of said engine at a normal pressure of approximately $1\times10^5$ Pascal, the water to be atomized is subjected to a high pressure and is injected in a pulsed form through a nozzle into said heated medium while said heated medium is at said normal pressure of approximately $1\times10^5$ Pascal, such that the water is atomized into very small particles, as a result of its high internal pressure, resulting in the water being explosively vaporized.

2. The method as defined in claim 1, wherein said water to be atomized is subjected to a pressure of approximately $1500\times10^5$ Pascal.

3. The method as defined in claim 1, wherein said medium has been heated to several hundred degrees Celsius.

4. The method as claimed in claim 1, wherein the water particles which are produced have a size of about 1 $\mu m^3$.

5. The method as claimed in claim 1, wherein, after leaving the engine, the steam is condensed to water again in a cooling device and the condensed water is fed back again into the water tank.

6. The method as claimed in claim 1, wherein the engine is thermally insulated in order to avoid heat losses.

7. A drive system comprising:

a) an engine having at least one engine area, b) a controlled nozzle which sprays the compressed water into the engine area at a variable pressure value of $1500\times10^5$ Pascal and is electronically controlled in order to regulate the amount injected, c) a high-pressure pump produces a pressure of preferably 1500 bar and is electronically controlled in order to ensure the amount injected, d) means for introducing hot medium into the engine area, into which water is injected, e) a suitable cooling device which ensures that the steam condenses again to form water, f) an insulating sheath which surrounds the engine therefore heating it by the heat which is produced by a burner.

8. The drive system as claimed in claim 7, wherein the heated medium comprises incandescent burner gases.

9. The drive system as claimed in claim 7, wherein the engine comprises at least two cylinders having a circular cross section which is delimited on both sides by a side wall provided with holes for bearing the drive shaft, an outlet of a medium-steam mixture, an inlet for the medium and for the water injection, a translation/rotation rotor being moveably in the cylinders which has an elliptical shape and divides each cylinder into two chambers with increasing and decreasing volumes, the drive shaft being arranged eccentrically in the circular cylinder.

10. The drive system as claimed in claim 9, wherein the rotor is connected to the shaft such that rotor and shaft rotate together while the rotor can also move linearly in the lateral direction, so that it can carry out a combined rotation and translation movement.

11. The drive system as claimed in claim 10, wherein the rotor has cutouts for a variable-length seal at both ends of the ellipse, so that during the rotation of the rotor, due to the cylinder area being circular and the rotation point of the shaft being arranged eccentrically, the rotor can seal a different length in each rotation position.

12. The drive system as claimed in claim 11, wherein the seals comprise three rollers, which are plugged one inside the other and have different diameters, such that the pressure ratios in the chambers result in one of the rollers being always pressed against the cylinder wall and seals the chambers from one another.

13. The drive system as claimed in claim 9, wherein, for each cylinder, the drive shaft has a milled-out area for an element which extends in the lateral direction, which, in adjacent cylinders, are angularly offset with respect to each other.

14. The drive system as claimed in claim 13, wherein two cylinders are provided and wherein the angular offset of the milled-out areas is 90°.

15. The drive system as claimed in claim 13, wherein the element is in the form of a plate with rounded edges, which can be pushed backwards and forwards in the milled-out area in the shaft, the ends of the plate being firmly anchored with the rotor, such that it can also carry out translation during its rotation.

16. The drive system as claimed in claim 9, wherein a cavity is formed in the center of the rotor and holds the drive shaft and the connecting rod plate.

17. The drive system as claimed in claim 9, on its side surfaces, the rotor has cutouts which open the inlet which is otherwise covered by the side surfaces of the rotor, the cutouts being chosen such that they open the inlet only for one eighth of the rotation of the rotor.

* * * * *